United States Patent [19]

Halverson

[11] 4,204,294

[45] May 27, 1980

[54] ELECTRICAL TERMINAL CLEANING DEVICE

[76] Inventor: Robert J. Halverson, 10525 W. Greenfield, Milwaukee, Wis. 53214

[21] Appl. No.: 953,539

[22] Filed: Oct. 23, 1978

[51] Int. Cl.[2] ..... A46B 7/02

[52] U.S. Cl. ..... 15/185; 7/168; 15/106

[58] Field of Search ..... 15/104.01 R, 106, 111, 15/185, 258, 203; 7/168; 206/362, 362.1, 362.2, 362.3

[56] References Cited

U.S. PATENT DOCUMENTS

| | | | |
|---|---|---|---|
| 1,500,852 | 7/1924 | Shephard | 7/168 X |
| 1,607,448 | 11/1926 | Dykes | 15/185 |
| 1,671,843 | 5/1928 | Scott | 15/104.01 R |
| 2,247,003 | 6/1941 | Smith et al. | 15/185 X |
| 2,473,758 | 6/1949 | Maitlen | 15/104.05 |
| 2,503,380 | 4/1950 | Derby | 15/104.05 X |
| 2,631,316 | 3/1953 | Heller | 15/106 |
| 3,797,055 | 3/1974 | Greene | 15/111 X |
| 4,038,715 | 8/1977 | Litt | 15/106 |

FOREIGN PATENT DOCUMENTS

| | | | |
|---|---|---|---|
| 803136 | 1/1952 | Fed. Rep. of Germany | 15/111 |
| 1034580 | 4/1953 | France | 15/185 |
| 1114734 | 12/1955 | France | 15/111 |

*Primary Examiner*—Edward J. McCarthy
*Attorney, Agent, or Firm*—Michael, Best & Friedrich

[57] ABSTRACT

A cleaning device comprises a handle member and one or more brushes, each brush having an abrasive bristle end. Each brush is mounted on the handle member for independent pivotal movement relative to the handle member between an operative position in which the abrasive bristle end extends outwardly of the handle member for use and an inoperative position in which the abrasive bristle end is contained within the confines of the handle member for storage.

4 Claims, 3 Drawing Figures

ELECTRICAL TERMINAL CLEANING DEVICE

BACKGROUND OF THE INVENTION

I. Field of the Invention

The invention relates generally to cleaning devices, and more particularly, to hand-held cleaning devices used to clean male and female electrical terminals.

II. Description of the Prior Art

Hand-held cleaning devices having abrasive bristle ends and integral handle members are known and disclosed in the following U. S. Pat. Nos.

Page, 1,950,862, Mar. 13, 1934

Boulicault, 2,399,660, May 7, 1946

Litt, 4,038,715, Aug. 2, 1977

In addition, French Pat. No. 278,888 discloses a hand-held abrasive brush cleaning tool.

Male and female electrical terminals, particularly those exposed to the weather, can become easily coated with dirt or salt and thereby corrode. This can impede the flow of electrical current through the terminals and ultimately lead to electrical failure.

Periodic cleaning of the electrical terminals by an electrical terminal cleaning device is desirable to prevent electrical failure. For this purpose, it is desirable to have an electrical terminal cleaning device which is compact and easily hand-held for transportation and manipulation during use, yet is versatile enough to clean different sizes and types of electrical terminals. None of the above mentioned patents balances the need for compactness with the need for versatility.

SUMMARY OF THE INVENTION

One of the objects of the invention is to provide a hand-held cleaning device having a compact handle member in which one or more cleaning tools can be stored when not in use but which tools can be quickly moved to and secured in an operative position.

Another object of the invention is to provide a hand-held cleaning device adaptable for holding a plurality of cleaning brushes, which device is thereby versatile enough to clean different sizes and types of electrical terminals.

To accomplish these and other objects, the invention provides a cleaning brush comprising a handle and one or more brushes, each brush having an abrasive bristle end and being mounted on the handle for pivotal movement between an operative position, in which the abrasive bristle end extends outwardly of the handle, and an inoperative position, in which the abrasive bristle end is contained within the confines of the handle.

More specifically, the handle includes a main body member having an interior pocket and an open portion permitting access into the interior pocket, and further includes a cover member pivotally attached to the main body member and movable between a first and a second position. In this embodiment, the brush is pivotally mounted on the main body for movement of the abrasive bristle end through the open portion between the inoperative position, in which the abrasive bristle end is confined within the interior pocket, and the operative position, in which the abrasive bristle end extends outwardly of the main body member. When the cover member is in the first position, pivotal movement of the abrasive bristle end through the open portion is permitted. In the second position, the cover member is adapted for registry within the main body member, thereby preventing pivotal movement of the adbrasive bristle end through the open portion. Locking means is provided for locking the cover member in the second position. The handle thereby forms a compact and portable carrying case for the brush when the brush is disposed in the inoperative position, while forming an effective means to manipulate the brush when the brush is disposed in the operative position.

In its preferred embodiment the interior pocket includes an end wall. A first shaft is adjacent to the end wall, and a second shaft is in the interior pocket spaced from the first shaft. A plurality of brushes is provided, and each brush includes an abrasive bristle end made of wire adapted to clean female electrical terminals, an end portion oppositely spaced from the abrasive bristle end, and a stem portion intermediate the end portion and the abrasive bristle end. In this embodiment, each brush end portion is independently pivotal on the first shaft, and the cover member is pivotally mounted on the second shaft thereby forming an easily operated flip top for the handle.

Also in its preferred embodiment, the end wall includes a plurality of slotted portions, with the number of slotted portions corresponding with the number of brushes. Each slotted portion is aligned with a brush and adapted to receive the stem portion of the respective brush when the brush is moved between the operative and inoperative positions. Each slotted portion substantially limits movement of the respective abrasive bristle end in a direction generally parallel to the first shaft when the respective brush is in the operative position. The control and manipulation of the brush for cleaning is thereby enhanced.

Also in its preferred embodiment, a tubular body is included having a first end portion pivotally attached to the first shaft and an open second end portion adapted to clean male electrical terminals. As the brushes, the tubular body is movable between an inoperative position in which the open second end portion is confined within the interior pocket and an operative position in which the open second end portion extends outwardly of the main body member. Similarly, the end wall includes an additional slotted portion adapted to slidably receive the tubular body and substantially limit the movement of the second open end portion in a direction generally parallel to the first shaft when the open second end portion is in the operative position.

Other objects and advantages will be pointed out in, or be apparent from, the specification and claims, as will obvious modifications of the embodiment shown in the drawings.

DESCRIPTION OF THE PREFERRED EMBODIMENT

Figure 1:
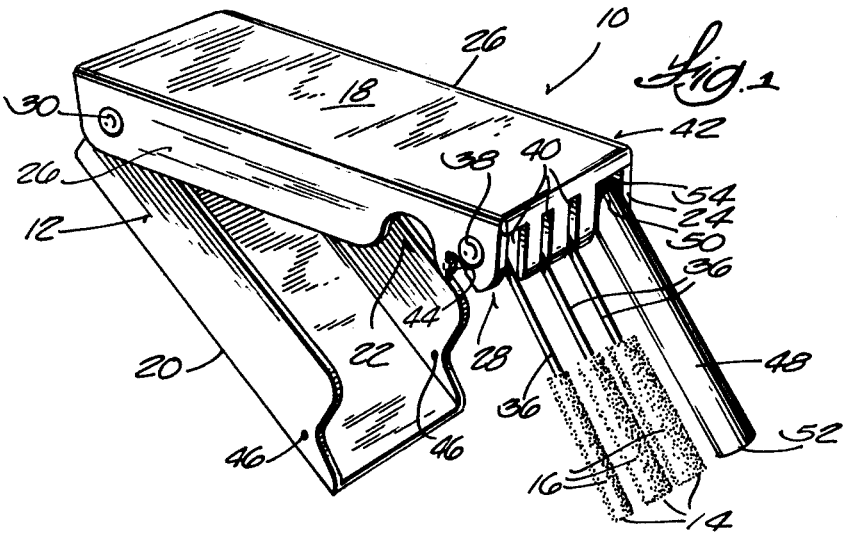
FIG. 1 is a perspective and partially fragmentary view of a cleaning brush which embodies the features of the invention and which shows the cover member in the open position.

A cleaning device 10 which embodies features of the invention is shown in FIG. 1. Generally, the device 10 includes a handle assembly 12 and one or more brushes 14, each brush having an abrasive bristle end 16. The brushes 14 are independently mounted on the handle assembly 12 for pivotal movement relative to the handle assembly 12 between an operative position (shown in FIG. 2), in which the abrasive bristle end 16 extends outwardly of the handle assembly 12 for use, and an inoperative position (shown in FIG. 3) in which the abrasive bristle end 16 is contained within the confines of the handle assembly 12 for storage.

While the handle assembly 12 may be variously constructed, in the illustrated embodiment, the handle assembly 12 includes a main body member 18 and a cover member 20. The main body member 18 has an interior pocket 22 partially defined by an end wall 24 and adjacent sidewalls 26 and an open end portion 28 permitting access into the interior pocket 22. A rear shaft 30 is mounted in the interior pocket 22 between the sidewalls 26 and is located so as to be oppositely spaced from the end wall 24. The cover member 20 is pivotally attached to the rear shaft 30 and movable between a first, or open, position, shown in FIGS. 1 and 3, permitting access into the interior pocket 22, and a second, or closed, position, shown in FIG. 2, in which the cover member 20 fits in registry within the main body member 18, thereby preventing access into the interior pocket 22. When the main body member 18 and the cover member 20 are in registry with each other, a hand-held handle assembly 12 is formed to effectively control and manipulate the brush 14 when the brush 14 is in its operative position. In addition, when the brush 14 is disposed in its inoperative position, the registry of the main body member 18 and the cover member 20 forms a compact carrying case to facilitate storage and movement of the cleaning device 10.

While this device 10 may include only a single brush 14, in the illustrated embodiment three brushes 14 are shown, each having abrasive bristle ends 16. The abrasive bristle ends 16 may be fashioned out of any suitable abrasive material, depending upon the intended use of the cleaning device 10. In the illustrated embodiment, the intended use of the device 10 is to clean electrical terminals, and the abrasive material is thus coarse wire 32 (See FIG. 3) adapted to scour dirt and corrosion from the electrical terminals. In particular, the brushes 14 are adapted to clean female electrical terminals, such as found on conventional plug-in taillight connectors for automobiles and trailers. Preferably the abrasive bristle ends 16 are of different diameters to lend versatility to the cleaning device 10.

Figure 3:
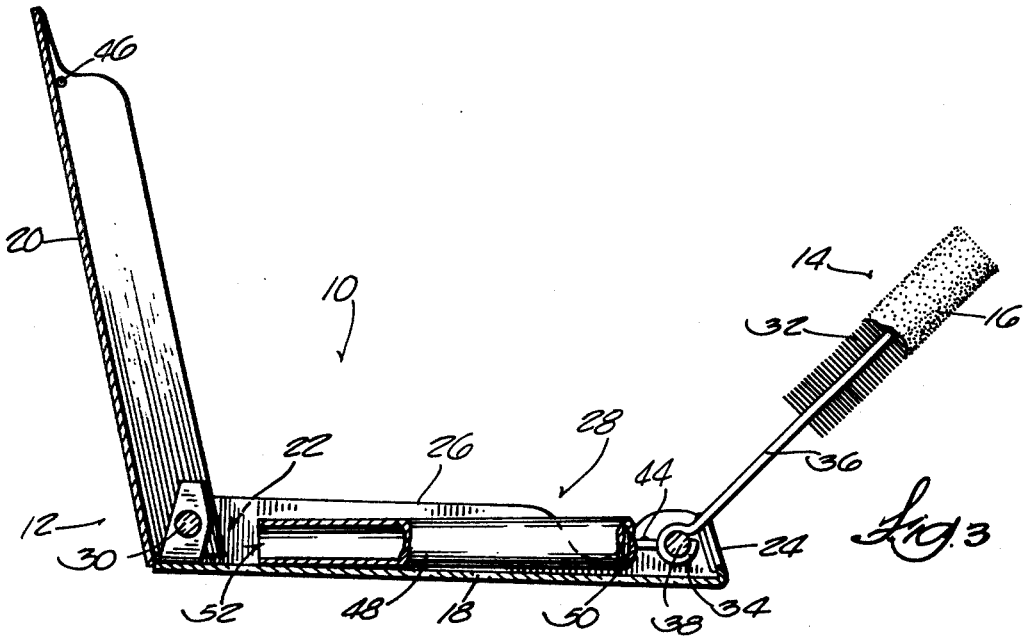
FIG. 3 is a side and partially fragmentary view of the cleaning brush shown in FIG. 1.

More particularly, and as best seen in FIG. 3, each brush 14 includes an end portion 34 oppositely spaced from the bristle end 16, and a stem portion 36 intermediate the bristle end 16 and the end portion 34. A front shaft 38 is mounted in the interior pocket 22 between the sidewalls 26 adjacent to the end wall 24, and the end portion 34 of each brush 14 is bent around the front shaft 38 to form a pivotal connection. Once each brush 14 is mounted in this fashion, each bristle end 16 can be independently pivoted into and out of the interior pocket 22 through the open end portion 28 when the cover member 20 is disposed in the open position (as shown in FIG. 3). Thus, it is possible to select the size of brush 14 desired, and to move only this brush 14 into the operative position, leaving the remaining brushes 14 in the inoperative position so as not to interfere with the cleaning operation.

Figure 2:
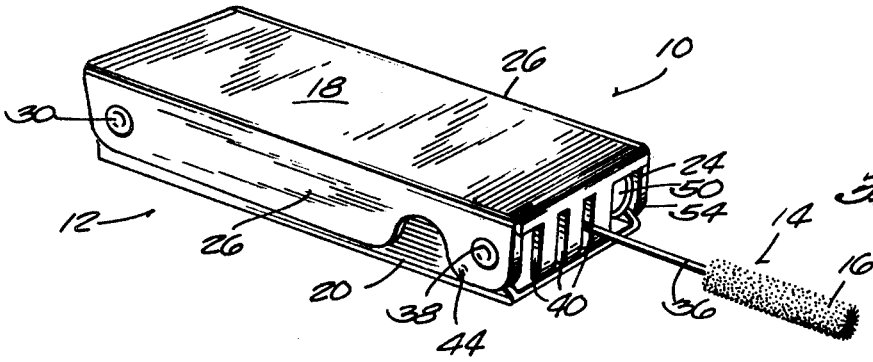
FIG. 2 is a perspective view of the cleaning brush shown in FIG. 1, except the cover member is shown in the closed position forming a handle to control and manipulate the cleaning brush.

As is best seen in FIGS. 1 and 2, the end wall 24 includes a plurality of slotted portions 40 corresponding in number with the number of brushes 14. As seen in FIG. 1, each slotted portion 40 is aligned with a respective brush 14 and adapted to receive the respective stem portion 36 when the brush 14 is being pivotally moved between the inoperative and the operative position. Once the brush 14 is disposed in the operative position, each slotted portion 40 acts to substantially limit movement of the respective bristle end 16 in a direction generally parallel to the front shaft 38. The slotted portion 40 thus acts to brace the respective brush 14 in the operative position to facilitate its use.

To further facilitate the use of the brush 14 when it is in the operative position, the cleaning device 10 includes locking means 42 for locking the cover member 20 in the closed position. While the locking means 42 may be variously constructed, in the illustrated embodiment, a pair of locking tabs 44 protrude from the sidewalls 26 of the main body member 18 and extend into the interior pocket 22 adjacent to the end wall 24. Correspondingly, the cover member 20 includes a matching pair of locking apertures 46 adapted for snap-fit engagement with the locking tabs 44 when the cover member 20 is disposed in the closed position. When locked in this position, up and down movement of the stem portion 36 of the brush 14 within the slotted portions 40 is substantially limited. The slotted portions 40 and the locking means 42 thus cooperate to reduce the free play of the abrasive bristle end 16 to facilitate its use when in the operative position. When the brushes 14 are in the inoperative position, the ability to lock the cover member 20 in the closed position also enhances the use of the handle assembly 12 as a carrying case.

Because conventional plug-in taillight connectors include male electrical terminals, the device includes a tubular body 48 having a first end portion 50 pivotally attached to the front shaft 38 adjacently to the end portions 34 of the brushes 14 and an open second end portion 52 adapted to scour dirt and corrosion off of male electrical terminals and movable between an inoperative position (shown in FIG. 3) and an operable position much in the same way as each brush 14 is pivotally movable into and out of the interior pocket 22. The end wall 24 includes an additional enlarged slotted portion 54 adapted to slidably receive the tubular body 48 much in the same way as the other slotted portions 40 are adapted to receive the stem portions 36 of the respective brushes 14 and with the same operative effect to limit free play of the open second end portion 52. Thus, the cleaning device 10 has the versatility to clean different types and sizes of electrical terminals, and the compactness to facilitate storage and hand-held use of the device 10.

Although but one embodiment of thG present invention has been illustrated and described, it will be apparent to those skilled in the art that various changes and modifications made be made therein without departing from the spirit of the invention or from the scope of the appended claims.

I claim:

1. A cleaning device comprising:

a main body member having an interior pocket including an end wall, said main body member also having an open portion permitting access into said interior pocket;

a first shaft adjacently located to said end wall and a second shaft in said interior pocket and spaced from said first shaft;

a plurality of brushes, each of said brushes including an abrasive bristle end, an end portion oppositely spaced from said abrasive bristle end, each of said end portions being individually pivotally attached to said first shaft for permitting independent pivotal movement of said respective brush through said open portion between an inoperative position in which said respective abrasive bristle end is confined within said interior pocket and an operative position in which said respective abrasive bristle end extends outwardly of said main body member, and a stem portion intermediate each of said end portions and said respective abrasive bristle end;

a cover member pivotally mounted on said second shaft for movement between a first position permitting pivotal movement of each of said abrasive bristle ends through said open portion and a second position preventing the pivotal movement; and wherein said end wall includes a plurality of slotted portions, the number of said slotted portions corresponding with the number of said brushes, each of said slotted portions being aligned with a respective one of said brushes and adapted to receive said respective stem portion when said respective brush is moved between said operative and inoperative positions, each of said slotted portions substantially limiting movement of said respective abrasive bristle end in a direction generally parallel to said first shaft when said respective brush is in said operative position.

2. A cleaning device according to claim 1:

further including a tubular scraper body having a first end portion pivotally attached to said first shaft and an open second end portion movable about said first shaft between an inoperative position in which said open second end portion is confined within said interior pocket and an operative position in which said open second end portion extends outwardly of said main body member; and wherein said end wall further includes an additional slotted portion adapted to slidably receive said tubular scraper body when said open second end portion is moved between said operative and inoperative positions, said additional slotted portion substantially limiting movement of said open second end portion in a direction generally parallel to said first shaft when said open second end portion is in said operative position.

3. A cleaning device comprising:

a main body member having an interior pocket including an end wall, said main body also having an open portion permitting access into said interior pocket;

a shaft located adjacent to said end wall;

a plurality of brushes, each of said brushes including an abrasive portion, an end portion oppositely spaced from said abrasive portion, each of said end portions being independently pivotally attached to said shaft for permitting pivotal movement of said respective brush about said shaft and through said open portion between an inoperative position in which said respective abrasive portion is confined within said interior pocket and an operative position in which said respective abrasive portion extends outwardly of said end wall, and a stem portion intermediate each of said end portions and said respective abrasive portion;

a cover member pivotally attached to said main body member and movable between a first position permitting pivotal movement of said abrasive portion through said open portion and a second position preventing the pivotal movement; and wherein said end wall includes a plurality of slotted portions, the number of said slotted portions corresponding with the number of said brushes, each of said slotted portions being aligned with a respective one of said brushes and adapted to receive said respective stem portion when said respective brush is moved between said operative and inoperative positions, each of said slotted portions substantially limiting movement of said respective abrasive portion in a direction generally parallel to said first shaft when said respective brush is in said operative position.

4. A cleaning device comprising:

a main body member having an interior pocket including an end wall, said main body also having an open portion permitting access into said interior pocket;

a shaft located adjacent to said end wall;

a brush including a wire stem having an abrasive end portion and an end portion oppositely spaced from said abrasive end portion and bent around said shaft to form a pivotal connection therewith so that said brush is pivotally movable through said portion between an inoperative position in which said abrasive portion is confined within said interior pocket and an operative position in which said abrasive portion extends outwardly of said end wall;

a cover member pivotally attached to said main body member and movable between a first position permitting pivotal movement of said abrasive portion through said open portion and a second position preventing the pivotal movement; and wherein said end wall includes a slotted portion adapted to slidably receive said wire stem when said brush is moved betweem said operative and inoperative positions, said slotted portion substantially limiting movement of said abrasive end in a direction generally parallel to said shaft when said brush is in said operative position.

* * * * *